US005384974A

United States Patent [19]

Massimo

[11] Patent Number: 5,384,974

[45] Date of Patent: Jan. 31, 1995

[54] ORTHOPEDIC SHOE INSERT WITH A YIELDING ELEMENT IN THE HEEL

[76] Inventor: Giontella Massimo, Via dei Bardi 58, 50125 Firenze, Italy

[21] Appl. No.: 122,642

[22] Filed: Sep. 16, 1993

Related U.S. Application Data

[63] Continuation of Ser. No. 907,306, Jul. 1, 1992, abandoned.

[30] Foreign Application Priority Data

Jan. 24, 1992 [IT] Italy ..... FI/92/A/19

[51] Int. Cl.[6] ..... A43B 13/28

[52] U.S. Cl. ..... 36/27; 36/28; 36/35 R; 36/43

[58] Field of Search ..... 36/27, 28, 35 R, 37, 36/43, 44, 71, 91, 92, 95, 105, 173, 174, 176, 178, 199, 35 B, 3 B, 29; 353;33/29

[56] References Cited

U.S. PATENT DOCUMENTS 2,826,834 3/1958 Ratcliff ..... 36/71
3,777,419 12/1973 Nalick ..... 36/71
4,928,404 5/1990 Scheuermann ..... 36/71
5,167,999 12/1992 Wang ..... 36/30 R

FOREIGN PATENT DOCUMENTS 2032761 5/1980 United Kingdom ..... 36/35 R

*Primary Examiner*—Paul T. Sewell
*Assistant Examiner*—Thomas P. Hilliard
*Attorney, Agent, or Firm*—McGlew and Tuttle

[57] ABSTRACT

Orthopedic shoe with flat bottom and plantar insole, provided with a silicone insert fitted between the bottom and the plantar insole which extends from the heel towards the tip of the shoe as far as the end of the plantar arch of the foot, said insert consisting, in correspondence of the heel, of a sector embedded in the heel and having upper flat surface, wherein an annular upwardly open cavity is provided to define an inner cylindrical yielding body for the support of the calcaneum and consisting, in correspondence of the central part of the bottom, of two longitudinal projections placed along the inner and outer sides, respectively, of the shoe for supporting the plantar arch.

8 Claims, 2 Drawing Sheets

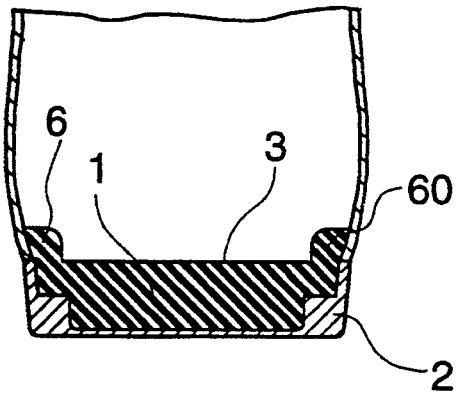
Fig. 3
Fig. 4
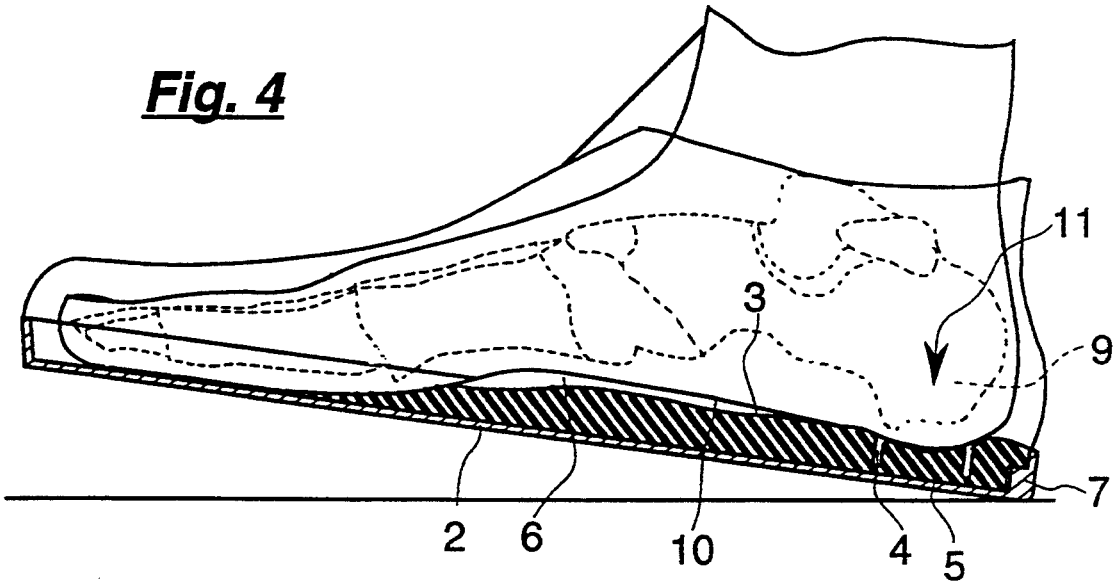

ORTHOPEDIC SHOE INSERT WITH A YIELDING ELEMENT IN THE HEEL

This is a continuation application of application Ser. No. 07/907,306 filed Jul. 1, 1992, now abandoned.

FIELD OF THE INVENTION

The present invention refers to an orthopedic shoe, especially for patients affected by limb relaxations and for hip-phrotesis wearers.

BACKGROUND OF THE INVENTION

It is known that many pathologies of the lower limb, such as the pathology of the midfoot, backfoot, leg, knee and femure, can be improved by dampening the load exerted on the heel and the plantar arch of the foot during the deambulation or the run.

In fact, in patients suffering from limb relaxations, the weighing down of the body through the foot resting surface, when no cushioning means are provided, causes the subsidence of the plantar arch and the pronation of the heel. This implies the formation of a flat-pronated foot and, in turn, the generation of several troubles of both physiological and psychological character.

It is likewise known that the hip phrotesis anchored to the pelvis by means of cements, tend to be displaced by the progressive disintegration of the cements themselves because of the vibration transmitted by the lower limbs to the acetabulum during the deambulation.

Furthermore, in case of fractures of the heel, which—as everybody knows—is the bone that supports 75% of the body weight during the deambulation, serious problems arise for the laying down of the foot, which calls for long periods of rehabilitation before the patient is able to regain a normal deambulation capability.

Similarly, the formation of calcaneal prickles and, mostly, or needle-like ossifications which occur beneath the heel, is cause for violent painful reactions when the foot rests onto the groin. Finally, the fractures of the leg and those of the femure, frequently take far more time to consolidate than usual, so that the impact of the foot onto the ground must take place only to a limited degree, or not taking place altogether, to avoid the occurrence of fractures.

In case of the above-mentioned fractures, the physiological repair process is strongly impaired, by the sudden impact of the foot onto the ground, also and, above all, by the vibrations transmitted to the whole lower limb upon the impact.

Also the arthrosis of the hip, of the knee and of the ankle, are subject to a progressive worsening if the foot is made to rest on the ground in the usual way, that is, without dampening the impact.

U.S. Pat. No. 4,928,404 discloses a calcaneum pad made of silicone rubber for insertion within a traditional shoe in correspondence of the heel below the wearer's calcaneum.

However, the disadvantages deriving from the above known heel paid consist essentially in that the only part which receives the cushioning action is the calcaneum and, accordingly, no action is exerted on the plantar arch to allow the message or the remodelling thereof. This is usually required in the rehabilitation process of the lower limbs in the majority of the previously mentioned pathologies.

Shoes are also known that are provided with elastic elements having linear elasticity, such as steel springs, fitted inside the heel to make it elastic.

However, the disadvantages deriving from these known shoes provided with springs fitted in the heel, lie essentially in the fact that during the relief phase, that is, when the foot is lifted from the ground, the springs give back all the elastic energy accumulated upon the weighing down phase, which is when the foot is made to rest on the ground. In this way the reaction exerted by the ground on the supporting foot is not dampened and is instead retransmitted unchanged onto the supporting lower limb. Also with these shoes, all the weight weighs down, during the deambulation, upon the calcaneum, which makes these type of shoes unsuitable for the massage and/or the remodelling of the plantar arch.

SUMMARY AND OBJECT OF THE PRESENT INVENTION

The main object of the present invention is to avoid the abovementioned drawbacks and achieve a distribution of dampened load over the calcaneum and, at the same time, on the plantar arch, when the foot rests on the ground.

This result has been achieved, according to the present invention, by adopting the idea of making an orthopedic shoe with a silicone insert. This insert is between the bottom of the shoe and the plantar insole, and extends from the heel towards the tip of the shoe as far as the end of the plantar arch of the foot. The insert has an annular cavity in correspondence with the heel, and defines a cylindrical supporting element for the calcaneum. Two side longitudinal projections are provided in correspondence with the central part of the shoe for supporting the plantar arch.

The advantages deriving from the present invention consist essentially in that the load of the foot onto the ground is dampened; that the vibrations transmitted to the lower limbs and to the pelvis are dampened; and that the patient's plantar arch is—at every step—subject to a slight, distributed thrust action upwardly directed.

These further advantages and characteristics of the invention will be better understood by any skilled in the art from a reading of the following description in conjunction with the attached drawings given as a practical example of the invention but not to be considered in a limiting sense, wherein:

BRIEF DESCRIPTION OF THE DRAWINGS

In the drawings:

FIG. 3 shows a section take on line III—III of FIG. 1;

FIG. 4 shows the central longitudinal section of the shoes of FIG. 1 with the foot weighing down on the ground through the heel tip;

DETAILED DESCRIPTION OF THE PREFERRED EMBODIMENTS

Figure 1:
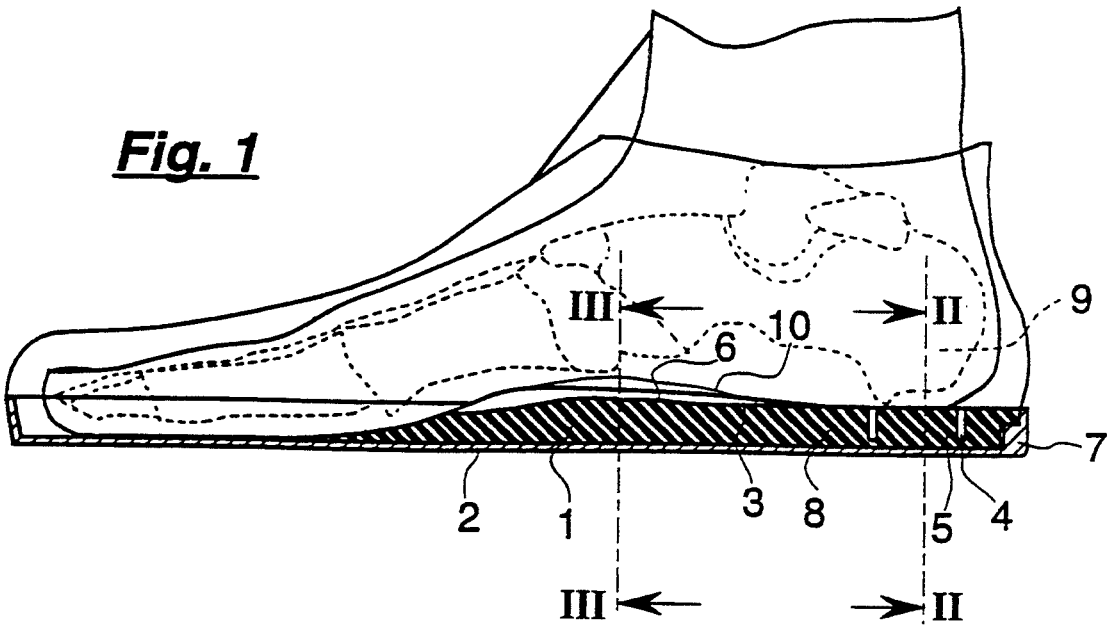
FIG. 1 shows a central longitudinal section of a shoe according to the invention, with the whole of the foot weighing down on the ground.
Figure 2:
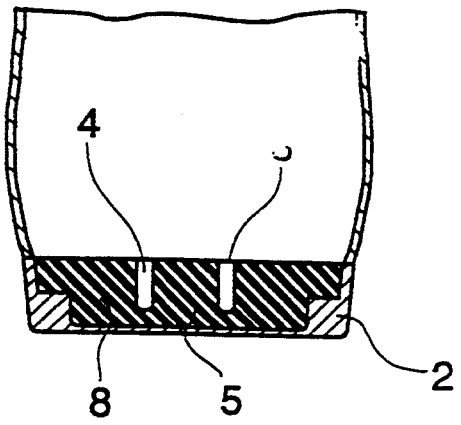
FIG. 2 shows a section take on line II—II of FIG. 1.

Reduced to its essential structure and with reference to the figures of the attached drawings, an orthopedic shoe according to the invention includes a flat bottom 2 with plantar insole surface 3, and a silicone insert 1 which is placed between the bottom 2 and the plantar insole 3. The invert 1 extends from the heel 7 towards the tip of the shoe as far as the end of the plantar arch of the foot. The insert 1 includes: in correspondence with the heel 7, a sector 8 embedded in the heel and having upper flat surface. This sector 8 is provided with an annular upwardly open cavity 4 able to define a cylindrical body or yield means 5 therein for the support of the calcaneum. The body 5 being united at the bottom to the sector 8 of insert 1 and on the top to the plantar insole surface 3. The Latter being made of flexible and partially elastic material. In correspondence of the central part of the shoe, two longitudinal projections 6,60 are placed along the inner and outer sides, respectively, of the shoe.

Advantageously, according to the invention, the body 5 of the sector 8 is intended to provide a support for the calcaneum 9 to hold up the maximum load exerted by the patient upon its weighing down on the heel during the deambulation. The body 5 has an outer diameter a few millimeters less that the internal diameter of cavity 4 so that, under loan, it will be able to freely deform in its height and width, without being hindered by the surrounding area of the sector 8.

Figure 5:
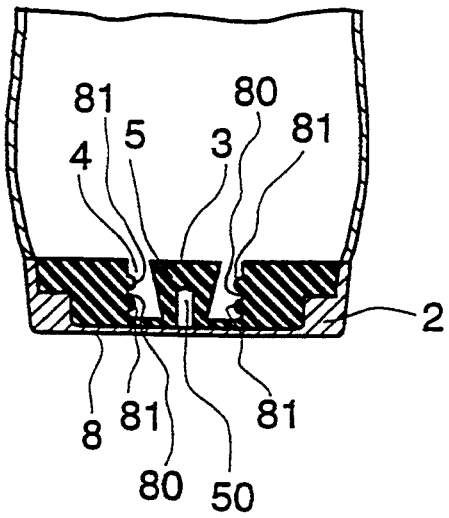
FIG. 5 shows an alternate embodiment of the present invention take along view line II—II of FIG. 1.

Alternatively, according to the invention and with reference to FIG. 5 of the attached drawings, the body 5 of sector 8 is of a truncated cone shape with vertical axis and the major base upwardly or downwardly located and, preferably, with an axial dead hole 50, that is, a hole open only at the bottom.

Moreover, according to the invention, the surface (BO) of sector 8 delimiting the cavity 4 is advantageously provided with two annular projections 81 which, when the body 5 and the surrounding area of sector 8 are acted upon by the force exerted through the foot, increase the resistance to the horizontal deformation of said sector 8 so as to cause said deformation to occur gradually and more slowly.

Furthermore, according to the invention, the two side longitudinal projections 6,60 may have equal or different width, but are of different length to account for the natural shape or curvature of the plantar arch 10, which exhibits a higher deflection in correspondence of the inner side of the foot.

The working of the shoe, according to the invention, during the deambulation is as follows:

By stepping forward with the leg, when the tip of the heel rests on the ground and the calcaneum 9 weighs down onto the sector 8 of insert 1 with a rapidly growing load, the same calcaneum goes down within the heel as the body 5 become deformed by a decrease of its height and an increase of its width. A progressively higher braking effect takes place as the load increases. As the load stops weighing down, the body 5 goes up and resumes the initial shape. Energy dissipates through elastic hysteresis, so that the reaction of the ground is also transmitted, as dampened, to the lower limb.

Besides, upon each lowering down of the calcaneum, owing to the subsidence of the body 5, the projections 6,60 of insert 1 make up a rigid support for the plantar arch 10 of the foot, thereby achieving an effective blood stimulation within the blood vessels of the arch and a remodelling of same plantar arch.

Practically, all the construction details may vary in any equivalent way as far as the form, dimensions, elements disposition, and nature of the used materials are concerned, without nevertheless departing from the scope of the adopted solution idea, and thereby, remaining within the limits of the protection granted to the present patent for industrial invention.

What is claimed is:

1. An orthopedic shoe insert for absorbing energy during ambulation, the insert comprising:

an elastic silicone material having a plantar insole surface positionable adjacent a foot and extending from a heel of the foot to a forward end of a plantar arch of the foot, said silicone material has a bottom side spaced from said plantar insole surface at the heel of the foot, said plantar insole surface and said bottom side extending from the heel of the foot and combining at the forward end of the plantar arch, said silicone material forming an outer circumference of an annular cavity adjacent the heel of the foot, said annular cavity being open through said plantar insole surface;

yielding means positioned substantially coaxially with said annular cavity and forming an inner circumference of said annular cavity, said yielding means for deforming in response to pressure from a calcaneum of the foot, said yielding means being formed as an integral part of said silicone material and having a truncated cone shape, one end of said yielding means being circular and positioned in substantially a same plane as said plantar insole surface, said yielding means having another end positioned at a bottom of said annular cavity and joining said silicone material, said another end of said yielding means being smaller than said one end of said yielding means;

an annular projection integrally formed with said silicone material and extending from said outer circumference of said annular cavity, said annular projection being spaced from said yielding means when said yielding means is in an undeformed state, and said annular projection contacting and deforming in response to said yielding means when said yielding means is severely deformed by the calcaneum of the foot.

2. An insert in accordance with claim 1, wherein:

said yielding body is formed of a material having elastic hysteresis.

3. An insert in accordance with claim 1, wherein:

an outer circumference of said yielding means is spaced from an outer circumference of said annular cavity.

4. An insert in accordance with claim 1, wherein:

said yielding means is positioned to receive pressure from the calcaneum during ambulation of the foot.

5. An insert in accordance with claim 1, wherein:

said insert and said yielding means are integrally formed of the same material.

6. An insert in accordance with claim 1, further comprising:

a first longitudinal side projection means positioned along an inner side of said silicone material and a second longitudinal side projection means positioned along an outer side of said silicone material, said first and second longitudinal side projections being for supporting the plantar arch of the foot.

7. An insert in accordance with claim 1, wherein:

an axis of said annular cavity is substantially perpendicular to said bottom side of said silicone material, said one end of said yielding means is united to a flexible and partially elastic material covering a portion of said plantar insole surface.

8. An insert in accordance with claim 7, wherein:

said flexible and partially elastic material extends across said annular cavity.

* * * * *